US009647360B2

(12) United States Patent
Chen et al.

(10) Patent No.: US 9,647,360 B2
(45) Date of Patent: May 9, 2017

(54) ELECTRICAL RECEPTACLE CONNECTOR

(71) Applicant: ADVANCED-CONNECTEK INC., New Taipei (TW)

(72) Inventors: Ching-Tien Chen, New Taipei (TW); Shu-Lin Duan, New Taipei (TW); Wei Wan, New Taipei (TW); Xiao-Juan Qi, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/272,837

(22) Filed: Sep. 22, 2016

(65) Prior Publication Data

US 2017/0085017 A1 Mar. 23, 2017

(30) Foreign Application Priority Data

Sep. 23, 2015 (CN) ..... 2015 1 0607495

(51) Int. Cl.

| | |
|---|---|
| ***H01R 13/648*** | (2006.01) |
| ***H01R 12/70*** | (2011.01) |
| ***H01R 24/60*** | (2011.01) |
| *H01R 107/00* | (2006.01) |

(52) U.S. Cl.

CPC ..... *H01R 12/7082* (2013.01); *H01R 24/60* (2013.01); *H01R 2107/00* (2013.01)

(58) Field of Classification Search

CPC ..... H01R 13/648; H01R 13/6581; H01R 13/6466

USPC ..... 439/607.01, 607.4, 676

See application file for complete search history.

(56) References Cited

U.S. PATENT DOCUMENTS

2015/0194770 A1* 7/2015 Little ..... H01R 13/6582 439/607.27

2015/0372424 A1* 12/2015 Little ..... H01R 13/642 439/217

2016/0104975 A1* 4/2016 Guo ..... H01R 13/6585 439/607.05

* cited by examiner

*Primary Examiner* — Abdullah Riyami
*Assistant Examiner* — Thang Nguyen
(74) *Attorney, Agent, or Firm* — Muncy, Geissler, Olds, & Lowe, P.C.

(57) ABSTRACT

An electrical receptacle connector includes an insertion module, an adapting circuit board, and an adapting terminal module. The insertion module and the adapting terminal module are on the adapting circuit board. The insertion module includes first and second receptacle terminals, a grounding plate, and an insulated housing. The first and the second receptacle terminals are fixed on the insulated housing. First and second tail portions of the first and the second receptacle terminals are protruding from the insulated housing, respectively. The adapting circuit board includes first, second, and third soldering portions. The first, second, and third tail portions are soldered with the first, second, and third soldering portions, respectively. The third receptacle terminal includes a third tail portion and a fourth tail portion. The third tail portions are soldered with the third soldering portions, and the fourth tail portions are protruding from the adapting insulated member.

12 Claims, 9 Drawing Sheets

ELECTRICAL RECEPTACLE CONNECTOR

CROSS-REFERENCE TO RELATED APPLICATION

This non-provisional application claims priority under 35 U.S.C. §119(a) to Patent Application No. 201510607495.9 filed in China, P.R.C. on Sep. 23, 2015, the entire contents of which are hereby incorporated by reference.

FIELD OF THE INVENTION

The instant disclosure relates to an electrical connector, and more particular to an electrical receptacle connector.

BACKGROUND

Universal Serial Bus (USB) is a serial bus standard commonly applied for computer, communication, and consumer electronics. Due to the developments of products in different aspects, demands for higher transmission speeds are urging. During high frequency signal transmission, severe crosstalk between terminals may occur in the case of the common USB 2.0 interfaces. In addition, the conventional USB 2.0 interfaces may suffer from radiofrequency interference (RFI) as well as electromagnetic interference (EMI) easily.

Regarding to the USB 3.0 interfaces, the crosstalk and interference problems may become serious due to the higher transmission speed which can be more than 5 Gbs of the USB 3.0 interfaces. To reduce the crosstalk, conventionally, a metallic grounding plate is positioned between upper and lower terminals. To reduce the radiofrequency interference and the electromagnetic interference, a metallic shell is applied to enclose the terminals. Nevertheless, the metallic shell commonly has a rear cover, which may increase the difficulty for soldering tail portions of the terminals on the circuit board during a packaging procedure.

Moreover, common soldering legs includes through-hole legs and flat legs (legs manufactured by surface mount technology). To standardize the soldering procedures of the circuit boards, in some cases the circuit board may include additional insertion holes or grooves. Therefore, upon the soldering procedure, solder empty or non-wetting problems may occur. Due that the structures of the components become complex and due to the aforementioned structure of the metallic shell, a person cannot check if holes or grooves of the circuit board are properly mated with the terminals (i.e., whether or not the pin assignments between the circuit board and the terminals are in right positions), and the connector may be difficult to be repaired. As a result, once the connector is damaged, the whole receptacle has to be detached from the assembled circuit board and repaired separately. Therefore, the overall cost for repairing the connector assembly may be very expensive.

SUMMARY OF THE INVENTION

In view of this, an embodiment of the instant disclosure provides an electrical receptacle connector. The electrical receptacle connector comprises an insertion module, an adapting circuit board, and an adapting terminal module. The insertion module comprises a plurality of first receptacle terminals, a plurality of second receptacle terminals, a grounding plate, and an insulated housing. The first receptacle terminals, the second receptacle terminals, and the grounding plate are fixed on the insulated housing. The first receptacle terminals are on one of two opposite sides of the insulated housing, and each of the first receptacle terminals comprises a first tail portion protruding from the insulated housing. The second receptacle terminals are on the other side of the insulated housing, and each of the second receptacle terminals comprises a second tail portion protruding from the insulated housing. The grounding plate is between the first receptacle terminals and the second receptacle terminals. The adapting circuit board comprises a plurality of first soldering portions, a plurality of second soldering portions, and a plurality of third soldering portions. A first side of the adapting circuit board faces the insertion module, and a second side of the adapting circuit board faces the adapting terminal module. The first tail portions are soldered with the first soldering portions. The second tail portions are soldered with the second soldering portions. The adapting terminal module comprises an adapting insulated member and a plurality of third receptacle terminals. Each of the third receptacle terminals comprises a third tail portion and a fourth tail portion respectively protruding from two sides of the adapting insulated member. The third tail portions are soldered with the third soldering portions.

In one embodiment, each of the first soldering portions and the second soldering portions is an insertion hole. In other words, the first tail portions and the second tail portions are inserted into the adapting circuit board from the first side by through-hole techniques. In one embodiment, each of the third soldering portions is an insertion hole. In other words, the third tail portions are inserted into the adapting circuit board from the second side by through-hole techniques.

In another embodiment, each of the third soldering portions is a soldering groove. In other words, the third tail portions are soldered with the second side of the adapting circuit board by surface mount technology (SMT). Furthermore, an opening direction of each of the third soldering portions and an opening direction of the corresponding first soldering portion create an angle, and the opening direction of each of the third soldering portions and an opening direction of the corresponding second soldering portion create the angle. Hence, after the first tail portions are soldered with the first soldering portions and the second tail portions are soldered with the second soldering portions as well as the third tail portions are soldered with the third soldering portions, each of the third tail portions and the corresponding first tail portion create the angle and each of the third tail portions and the corresponding second tail portion create the angle. It is understood that the structural configurations described in this paragraph may be altered according to different condition.

In one embodiment, the adapting terminal module further comprises a plurality of fixing posts extending from the adapting insulated member and inserted into a plurality of fixing holes of the adapting circuit board, respectively. Accordingly, the adapting terminal module can be fixed and positioned with the adapting circuit board.

In one embodiment, the grounding plate further comprises a plurality of insertion legs, and the adapting circuit board further comprises a plurality of grounding insertion holes. The insertion legs correspond to the grounding insertion holes and soldered into the grounding insertion holes. Therefore, a grounding circuit can be formed.

In one embodiment, the electrical receptacle connector further comprises a first conductive sheet and a second conductive sheet. The first conductive sheet is on a first surface of the insertion module, the second conductive sheet is on a second surface of the insertion module, and the first surface is opposite to the second surface. The first conductive sheet and the second conductive sheet respectively shield parts of the first receptacle terminals and parts of the second receptacle terminals for retarding electromagnetic interferences and radiofrequency interferences. Moreover, the first conductive sheet is engaged with the insulated housing and in contact with a first ground terminal of the first receptacle terminals. the second conductive sheet is engaged with the insulated housing and in contact with the second ground terminal of the second receptacle terminals. Hence, another grounding circuit is further formed to further retarding the electromagnetic interferences and radiofrequency interferences.

In one embodiment, the electrical receptacle connector further comprises a metallic shell enclosing the insertion module, the adapting circuit board, and the adapting terminal module. The metallic shell shields the first receptacle terminals and the second receptacle terminals, and the fourth tail portions are exposed from the metallic shell. Moreover, the metallic shell comprises two protecting legs at two sides of the fourth tail portions.

In one embodiment, the insertion module comprises a first terminal module, a second terminal module, and a grounding plate module. The first terminal module comprises the first receptacle terminals and a first insulated positioning member fixed and positioned with the first receptacle terminals. The second terminal module comprises the second receptacle terminals and a second insulated positioning member fixed and position with the second receptacle terminals. The grounding plate module comprises the grounding plate and a grounding insulated member. The grounding insulated member is on an outer surface of the grounding plate and assembled with the first insulated positioning member and the second insulated positioning member. Moreover, after the first terminal module, the second terminal module, and the grounding plate module are assembled with each other, the first terminal module, the second terminal module, and the grounding plate module are positioned with each other by molding techniques.

Accordingly, signals transmitted by the first receptacle terminals or the second receptacle terminals of the insertion module can be adapted to different mating connector by adapting the insertion module with the adapting circuit board and the adapting terminal module. Therefore, the insertion module can be provided as a standard piece. Hence, different legs can be adapted with the insertion module through the adapting circuit board and the adapting terminal module. Moreover, the external circuit board is only connected to the adapting terminal module, so the pin assignments of the soldering configuration can be standardized. Therefore, the connector can have a simple appearance and easy to be repaired.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
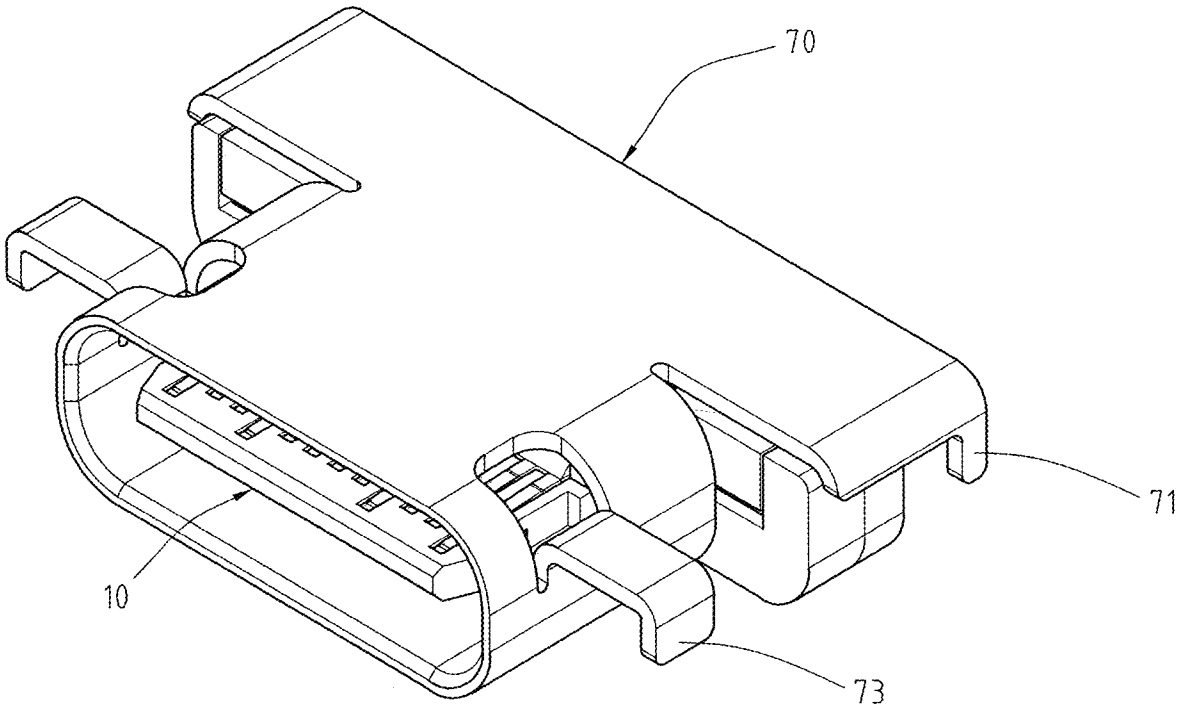
FIG. 1 illustrates a perspective view of an electrical receptacle connector according to an exemplary embodiment of the instant disclosure.
Figure 2:
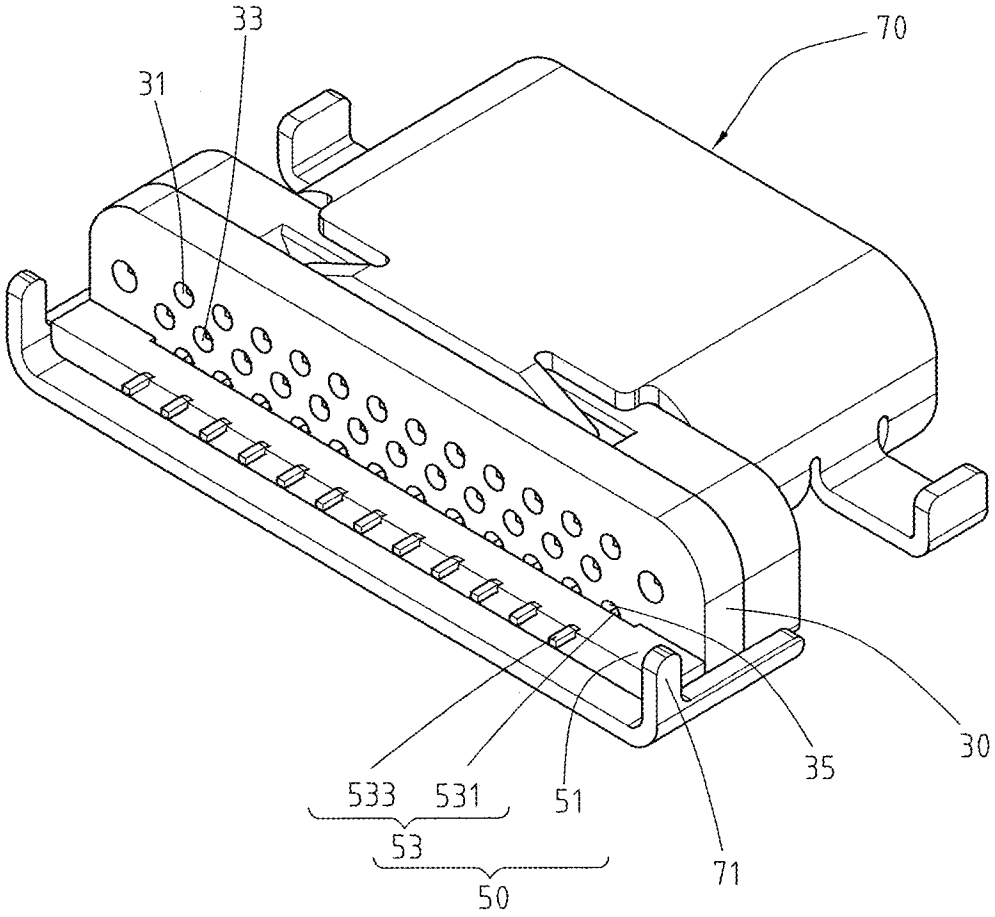
FIG. 2 illustrates a perspective view from the rear of the electrical receptacle connector of FIG. 1.
Figure 3:
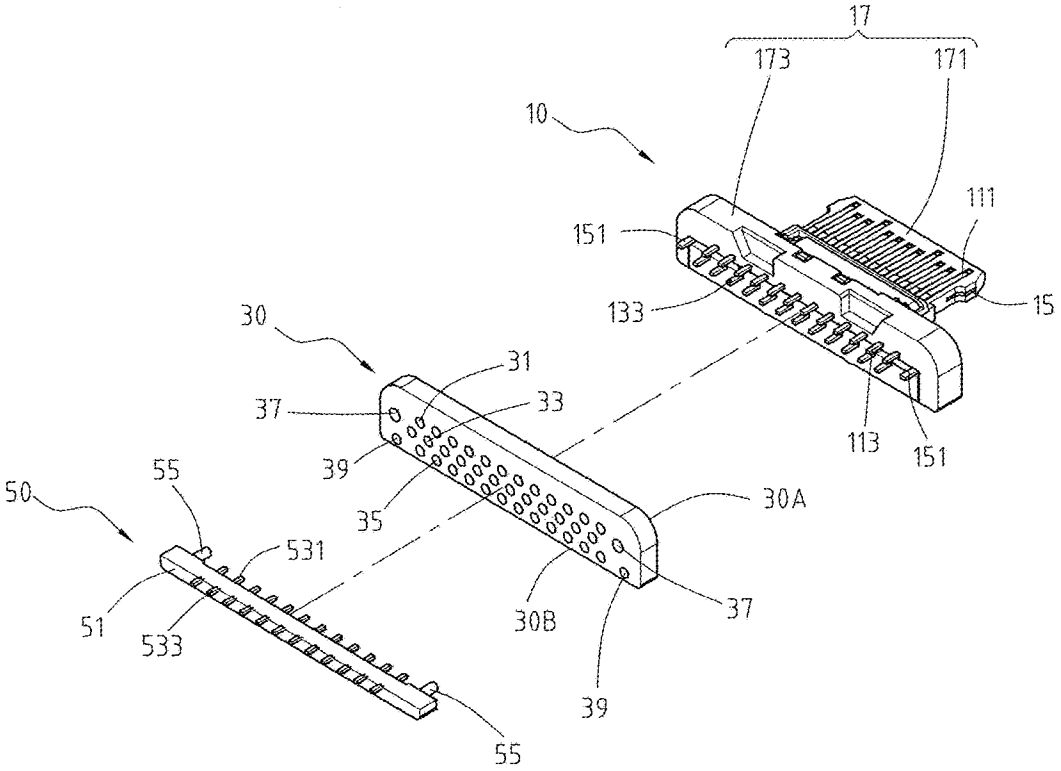
FIG. 3 illustrates a partial exploded view of the electrical receptacle connector of FIG. 1.
Figure 4:
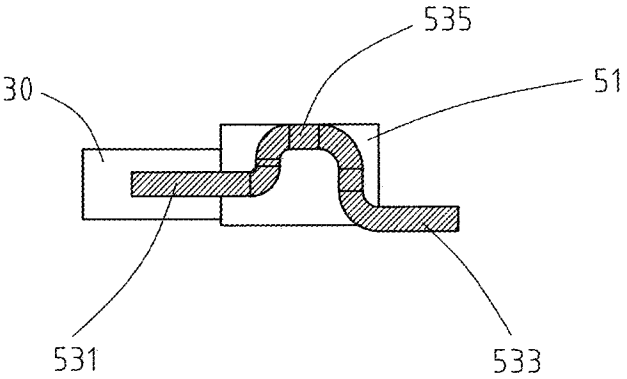
FIG. 4 illustrates a partial plan sectional view of an adapting circuit board and an adapting terminal module of the electrical receptacle connector of FIG. 1.

Please refer to FIGS. 1 to 4, illustrating an electrical receptacle connector of an exemplary embodiment of the instant disclosure. FIG. 1 illustrates a perspective view of an electrical receptacle connector according to an exemplary embodiment of the instant disclosure. FIG. 2 illustrates a perspective view from the rear of the electrical receptacle connector of FIG. 1. FIG. 3 illustrates a partial exploded view of the electrical receptacle connector of FIG. 1. FIG. 4 illustrates a partial plan sectional view of an adapting circuit board and an adapting terminal module of the electrical receptacle connector of FIG. 1. As shown in FIGS. 1 to 4, the electrical receptacle connector 1 comprises an insertion module 10, an adapting circuit board 30, and an adapting terminal module 50.

As shown in FIGS. 2 and 3, the insertion module 10 and the adapting terminal module 50 are respectively on a first side 30A and a second side 30B of the adapting circuit board 30. The insertion module 10 comprises a plurality of first receptacle terminals 11, a plurality of second receptacle terminals 13, a grounding plate 15, and an insulated housing 17. The first receptacle terminals 11 are on one side of the insertion module 10 (e.g., an upper side of the insertion module 10). First flat contact portions 111 of the first receptacle terminals 11 are held in a tongue portion 171 of the insulated housing 17, and first tail portions 113 of the first receptacle terminals 11 are protruding from a base portion 173 of the insulated housing 17. The second receptacle terminals 13 are on the other side of the insertion module 10 opposite to the first receptacle terminals 11 (e.g., a lower side of the insertion module 10). Second flat contact portions 131 of the second receptacle terminals 13 are held in the tongue portion 171 of the insulated housing 17, and second tail portions 133 of the second receptacle terminals 13 are protruding from the base portion 173 of the insulated housing 17.

The adapting circuit board 30 comprises a plurality of first soldering portion 31, a plurality of second soldering portion 33, and a plurality of third soldering portions 35. The first tail portions 113 are soldered with the first soldering portions 31, and the second tail portions 133 are soldered with the second soldering portions 33. In this embodiment, each of the first soldering portions 31 and the second soldering portions 33 is an insertion hole. In other words, the first tail portions 113 and the second tail portions 133 are inserted into the adapting circuit board 30 from the first side 30A by through-hole techniques. In addition, the number of the first soldering portions 31 and the number of the second soldering portions 33 may be equal to or more than the number of the first tail portions 113 and the number of the second tail portions 133, respectively.

The adapting terminal module 50 comprises an adapting insulated member 51 and a plurality of third receptacle terminals 53 molded with the adapting insulated member 51. Each of the third receptacle terminals 53 comprises a third tail portion 531 and a fourth tail portion 533 respectively protruding from two sides of the adapting insulated member 51, and the third tail portions 531 are soldered with the third soldering portions 35. In this embodiment, the third soldering portions 35 may also be an insertion hole. Accordingly, the third tail portions 531 may be soldered with the third soldering portions 35 from the second side 30B by through-hole techniques.

The fourth tail portions 533 are for soldering with an external circuit board (not shown) by through-hole techniques or surface mount technology (SMT). In addition, the adapting terminal module 50 further comprises a plurality of fixing posts 55 extending toward the second side 30B from the adapting insulated member 51 for respectively inserted into fixing holes 39 of the adapting circuit board 30. Therefore, the adapting circuit board 30 and the adapting terminal module 50 can be positioned with each other by the mating between the fixing posts 55 and the fixing holes 39.

As shown in FIG. 4, from a sectional view, each of the third receptacle terminals 53 further comprises a third body portion 535 held in the adapting insulated member 51. For each of the third receptacle terminals 53, two ends of the third body portion 535 are respectively connected to the third tail portion 531 and the fourth tail portion 533. In this embodiment, the third tail portions 531 and the fourth tail portions 533 are respectively extending toward two sides (e.g., front and rear sides) of the adapting insulated member 51, and the extension direction of the third tail portions 531 may be parallel with the extension direction of the fourth tail portions 533. The third tail portions 531 may be vertically inserted into the third soldering portions 35.

Figure 5:
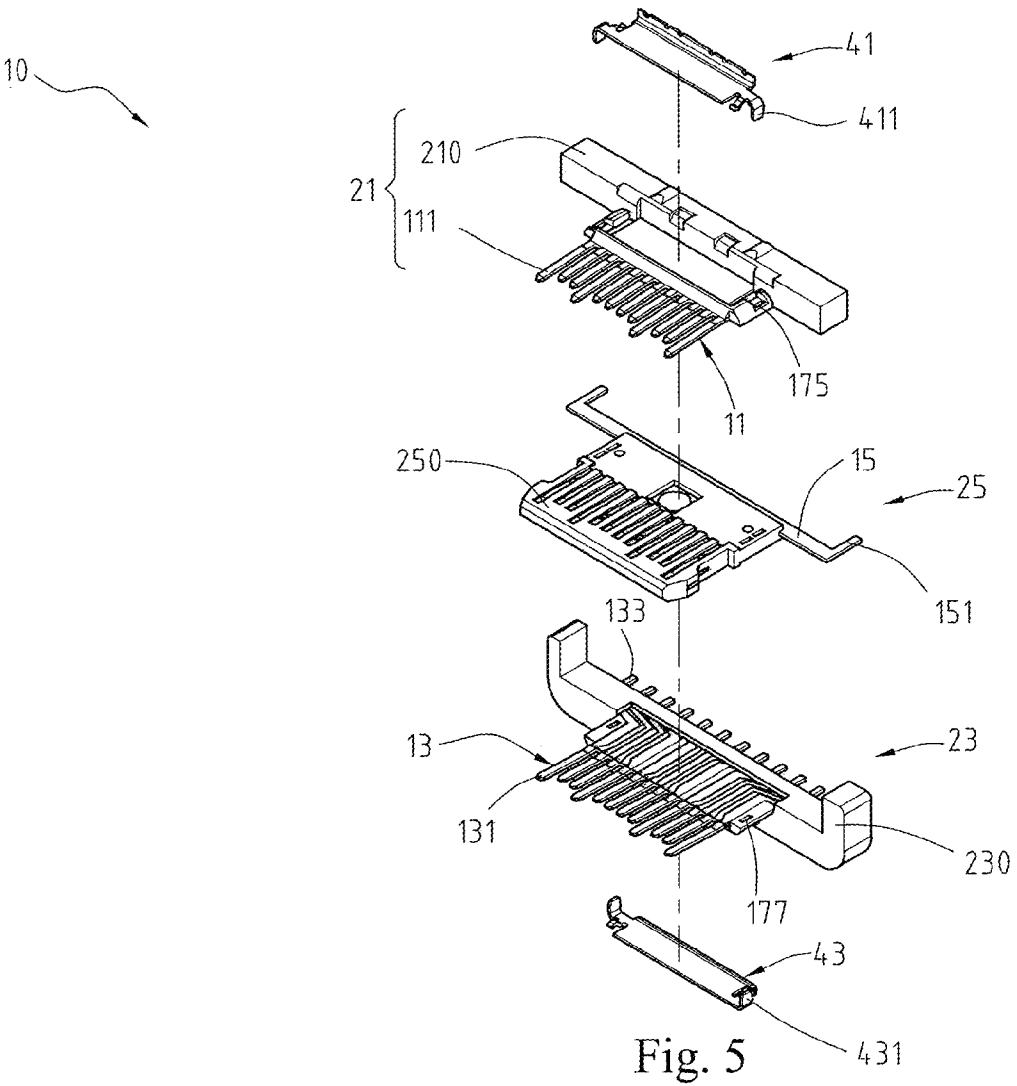
FIG. 5 illustrates an exploded view of an insertion module of the electrical receptacle connector of FIG. 1.
Figure 6:
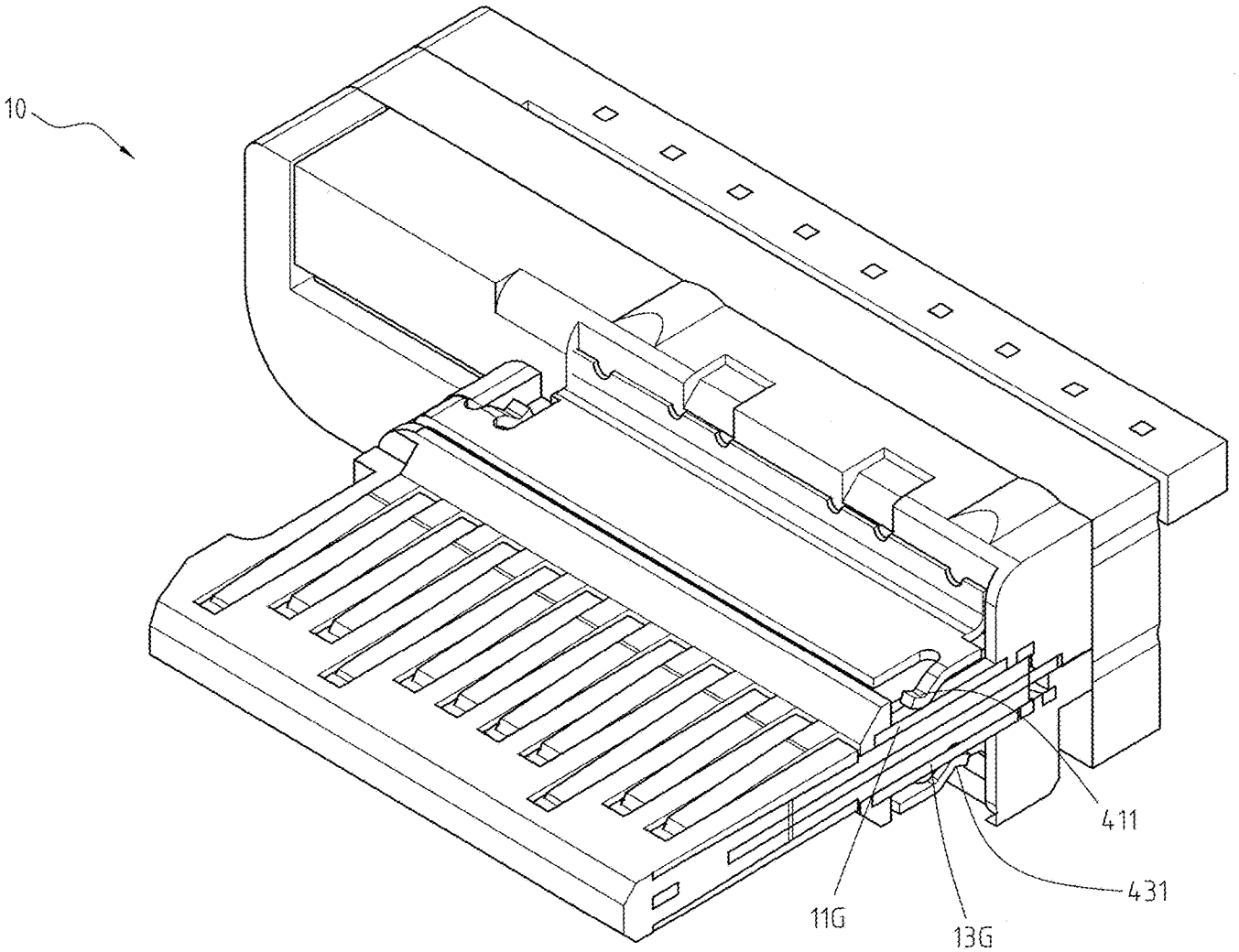
FIG. 6 illustrates a partial perspective sectional view of the insertion module of the electrical receptacle connector of FIG. 1.

Please refer to FIGS. 5 and 6. FIG. 5 illustrates an exploded view of an insertion module of the electrical receptacle connector of FIG. 1. FIG. 6 illustrates a partial perspective sectional view of the insertion module of the electrical receptacle connector of FIG. 1. As shown in FIGS. 5 and 6, the insertion module 10 comprises a first terminal module 21, a second terminal module 23, and a grounding plate module 25. The first terminal module 21 comprises the first receptacle terminals 11 and a first insulated positioning member 210 fixed and positioned with the first receptacle terminals 11. The first flat contact portions 111 and the first tail portions 113 are protruding from the first insulated positioning member 210. The second terminal module 23 comprises the second receptacle terminals 13 and a second insulated positioning member 230 fixed and positioned with the second receptacle terminals 13. The second flat contact portions 131 and the second tail portions 133 are protruding from the second insulated positioning member 210. The grounding plate module 25 is between the first terminal module 21 and the second terminal module 23. The grounding plate module 25 comprises a grounding plate 15 and a grounding insulated member 250. The grounding insulated member 250 is on a portion of an outer surface of the grounding plate 15 for assembling with the first terminal module 21 and the second terminal module 23. The first terminal module 21, the second terminal module 23, and the grounding plate module 25 are assembled and molded with each other to form the insulated housing 17, for example, by insert-molding techniques. After the molding, the first flat contact portions 111 and the second flat contact portions 131 are held in the tongue portion 171.

Please refer to FIG. 3. The grounding plate 15 further comprises a plurality of insertion legs 151. The adapting circuit board 30 further comprises a plurality of grounding insertion holes 37. The insertion legs 151 correspond to the grounding insertion holes 37, and the insertion legs 151 are soldered into the respective grounding insertion holes 37.

Accordingly, the components of the connector are separately modulized and then assembled with each other by molding. Therefore, the modulized design of the connector allows the mold for components being sharable and utilizable in connector with different models. Hence, the cost for mold design can be reduced. In addition, since the terminals are molded with the module in advance, the pin assignments of the tail portions of the terminals can be aligned properly.

Furthermore, the electrical receptacle connector 1 further comprises a first conductive sheet 41 and a second conductive sheet 43. The first conductive sheet 41 is on a first surface of the insertion module 10, for example, an upper surface, for shielding parts of the first receptacle terminals 11. The second conductive sheet 43 is on a second surface of the insertion module 10, for example, a lower surface. The first surface is opposite to the second surface. As shown in FIGS. 5 and 6, a first engaging block 411 of the first conductive sheet 41 is engaged into a first engaging hole 175 of the insulated housing 17 and is in contact with a first ground terminal 11G of the first receptacle terminals 11. A second engaging block 431 of the second conductive sheet 43 is engaged into a second engaging hole 177 of the insulated housing 17 and is in contact with a second ground terminal 13G of the second receptacle terminals 13. Accordingly, a grounding circuit can be formed for further retarding electromagnetic interferences and radiofrequency interferences.

Figure 7:
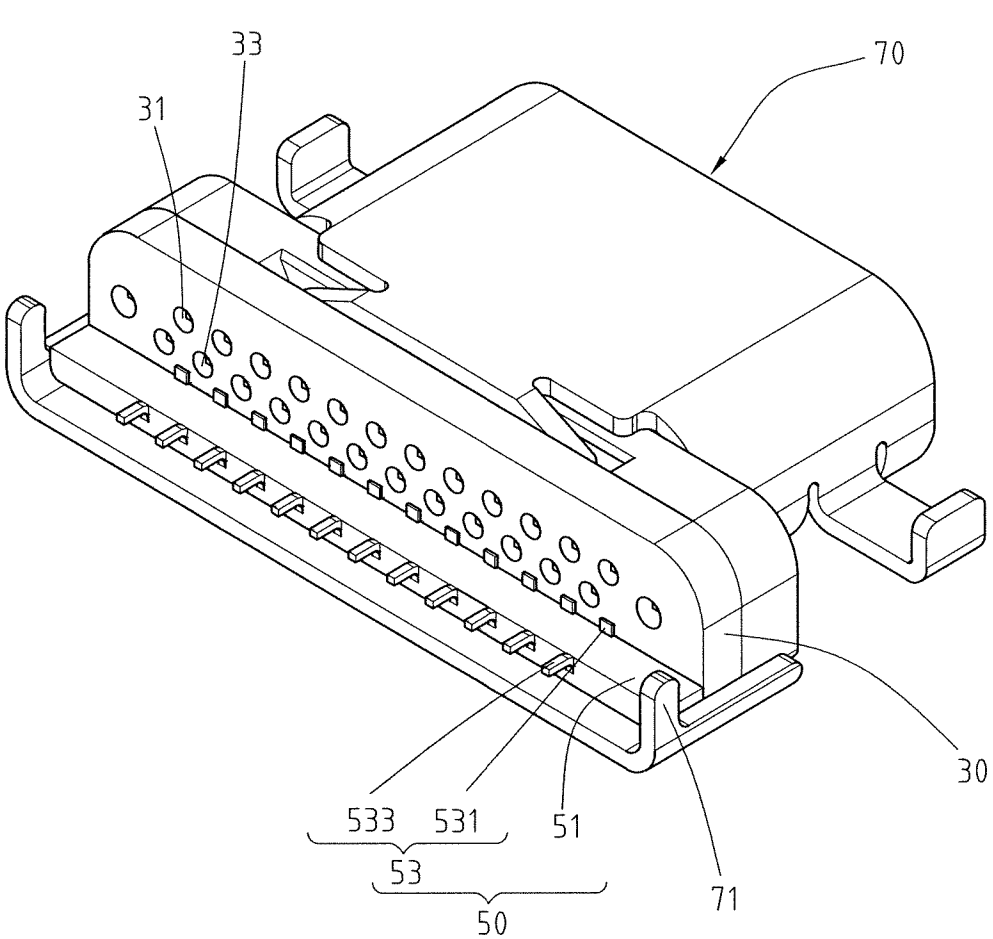
FIG. 7 illustrates a perspective view from the rear of an electrical receptacle connector according to another embodiment of the instant disclosure.
Figure 8:
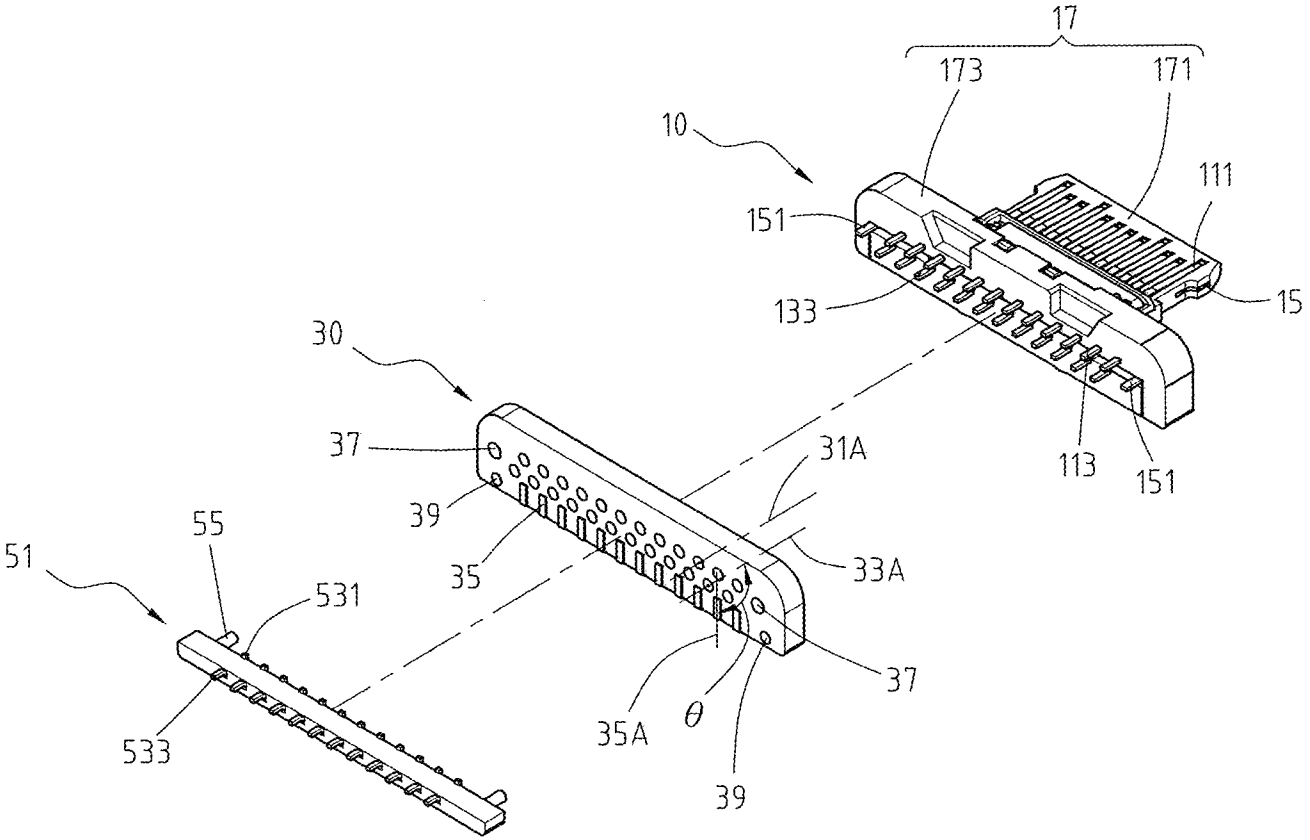
FIG. 8 illustrates a partial exploded view of the electrical receptacle connector of FIG. 7.
Figure 9:
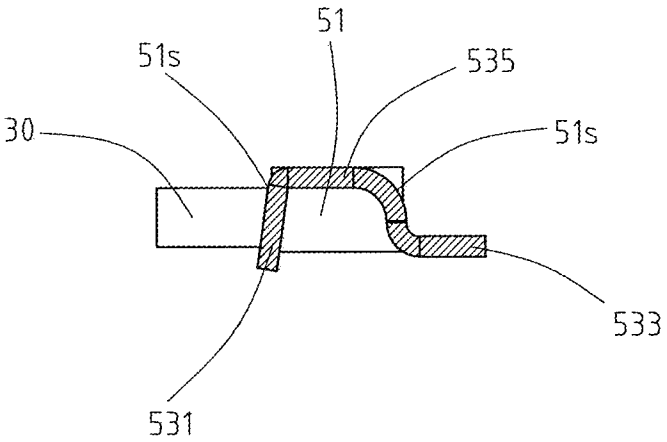
FIG. 9 illustrates a partial plan sectional view of an adapting circuit board and an adapting terminal module of the electrical receptacle connector of FIG. 7.

Please refer to FIGS. 7 to 9. FIG. 7 illustrates a perspective view from the rear of an electrical receptacle connector according to another embodiment of the instant disclosure. FIG. 8 illustrates a partial exploded view of the electrical receptacle connector of FIG. 7. FIG. 9 illustrates a partial plan sectional view of an adapting circuit board and an adapting terminal module of the electrical receptacle connector of FIG. 7. As shown in FIGS. 7 to 9, in this embodiment, the electrical receptacle connector 2 also comprises an insertion module 10, an adapting circuit board 30, and an adapting terminal module 50. The structure of the insertion module 10 in this embodiment is approximately the same as that described in the first embodiment, and descriptions about the insertion module 10 in this embodiments are not provided accordingly.

In this embodiment, the third soldering portion 35 is a soldering groove. The angle created by an opening direction 35A of each of the third soldering portions 35 and an opening direction 31A of the corresponding first soldering portion 31 is θ as shown in FIG. 8, and the angle created by the opening direction 35A of each of the third soldering portions 35 and the opening direction 33A of the corresponding second soldering portion 33 is θ. In this embodiment, the third tail portions 531 are soldered with the third soldering portions 35 by surface mount technology (SMT). Therefore, the third tail portions 531 are provided as flat legs and soldered on the adapting circuit board 30. After the first tail portions 113 are soldered with the first soldering portions 31 and the second tail portions 113 are soldered with the second soldering portions 33 as well as the third tail portions 531 are soldered with the third soldering portions 35, the angle created by each of the third tail portions 531 and the corresponding first tail portion 113 is θ, and the angle created by each of the third tail portions 531 and the corresponding second tail portion 133 is θ.

As shown in FIG. 9, in this embodiment, each of the third receptacle terminals 53 further comprises a third body portion 535 held in the adapting insulated member 51. For each of the third receptacle terminals 53, two ends of the third body portion 535 are respectively connected to the third tail portion 531 and the fourth tail portion 533. In this embodiment, the third tail portions 531 and the fourth tail portions 533 are respectively protruding from two lateral surfaces 51*s* of the adapting insulated member 51. The extension direction of the fourth tail portions 533 is almost vertical to the lateral surface 51*s*, and the third tail portions 531 are almost flushed on the lateral surface 51*s*. From the figures, the third tail portion 531 is almost vertical to the fourth tail portion 533.

Please refer to FIGS. 1, 2, and 7. The electrical receptacle connector 1 further comprises a metallic shell 70 enclosing the insertion module 10, the adapting circuit board 30, and the adapting terminal module 50. The metallic shell 70 shields the first receptacle terminals 11 and the second receptacle terminals 13. The fourth tail portions 531 are exposed from the metallic shell 70. Moreover, the metallic shell 70 comprises two protecting legs 71 at two sides of the fourth tail portions 531. The protecting legs 71 are for guiding the metallic shell 70 to be soldered with an external circuit board (not shown) and preventing the terminals from being soldered with the circuit board in a wrong configuration. The fourth tail portions 531 are exposed from the metallic shell 70 so as to be checked and repaired easily. Furthermore, the metallic shell 70 further comprises two soldering legs 73 for being soldered with an external circuit board (not shown).

Accordingly, signals transmitted by the first receptacle terminals or the second receptacle terminals of the insertion module can be adapted to different mating connector by adapting the insertion module with the adapting circuit board and the adapting terminal module. Therefore, the insertion module can be provided as a standard piece. Hence, different legs can be adapted with the insertion module through the adapting circuit board and the adapting terminal module. Moreover, the external circuit board is only connected to the adapting terminal module, so the pin assignments of the soldering configuration can be standardized. Therefore, the connector can have a simple appearance and easy to be repaired.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

an insertion module comprising a plurality of first receptacle terminals, a plurality of second receptacle terminals, a grounding plate, and an insulated housing, wherein the first receptacle terminals, the second receptacle terminals, and the grounding plate are fixed on the insulated housing, the first receptacle terminals are on one of two opposite sides of the insulated housing, and each of the first receptacle terminals comprises a first tail portion, the second receptacle terminals are on the other side of the insulated housing, and each of the second receptacle terminals comprises a second tail portion, the first tail portions and the second tail portions are protruding from the insulated member, and the grounding plate is between the first receptacle terminals and the second receptacle terminals;

an adapting circuit board comprising a plurality of first soldering portions, a plurality of second soldering portions, and a plurality of third soldering portions, a first side of the adapting circuit board faces the insertion module, the first tail portions of the first receptacle terminals are soldered with the first soldering portions, the second tail portions of the second receptacle terminals are soldered with the second soldering portions; and an adapting terminal module on a second side of the adapting circuit board opposite to the first side, wherein the adapting terminal module comprises an adapting insulated member and a plurality of third receptacle terminals, each of the third receptacle terminals comprises a third tail portion and a fourth tail portion respectively protruding from two sides of the adapting insulated member, and the third tail portions are soldered with the third soldering portions.

2. The electrical receptacle connector according to claim 1, wherein each of the first soldering portions and the second soldering portions is an inserting hole.

3. The electrical receptacle connector according to claim 2, wherein each of the third soldering portions is an inserting hole.

4. The electrical receptacle connector according to claim 2, wherein each of the third soldering portions is a soldering groove, an opening direction of each of the third soldering portions and an opening direction of the corresponding first soldering portion create an angle, and the opening direction of each of the third soldering portions and an opening direction of the corresponding second soldering portion create the angle.

5. The electrical receptacle connector according to claim 4, wherein the first tail portions are respectively soldered with the first soldering portions, the second tail portions are respectively soldered with the second soldering portions, the third tail portions are respectively soldered with the third soldering portions, each of the third tail portions and the corresponding first tail portion create an angle, and each of the third tail portions and the corresponding second tail portion create the angle.

6. The electrical receptacle connector according to claim 1, wherein the adapting terminal module further comprises a plurality of fixing posts extending from the adapting insulated member and inserted into a plurality of fixing holes of the adapting circuit board, respectively.

7. The electrical receptacle connector according to claim 1, wherein the grounding plate further comprises a plurality of insertion legs, the adapting circuit board further comprises a plurality of grounding insertion holes, the insertion legs correspond to the grounding insertion holes, and the insertion legs are soldered into the respective grounding insertion holes.

8. The electrical receptacle connector according to claim 1, further comprising a first conductive sheet and a second conductive sheet, wherein the first conductive sheet is on a first surface of the insertion module, the second conductive sheet is on a second surface of the insertion module, wherein the first surface is opposite to the second surface.

9. The electrical receptacle connector according to claim 8, wherein the first conductive sheet is engaged with the insulated housing and in contact with a first ground terminal of the first receptacle terminals, the second conductive sheet is engaged with the insulated housing and in contact with a second ground terminal of the second receptacle terminals.

10. The electrical receptacle connector according to claim 1, further comprising a metallic shell enclosing the insertion module, the adapting circuit board, and the adapting terminal module, wherein the metallic shell shields the first receptacle terminals and the second receptacle terminals, and the fourth tail portions are exposed from the metallic shell.

11. The electrical receptacle connector according to claim 10, wherein the metallic shell comprise two protecting legs at two sides of the fourth tail portions.

12. The electrical receptacle connector according to claim 1, wherein the insertion module comprises a first terminal module, a second terminal module, and a grounding plate module, the first terminal module comprises the first receptacle terminals and a first insulated positioning member fixed and positioned with the first receptacle terminals, the second terminal module comprises the second receptacle terminals and a second insulated positioning member fixed and positioned with the second receptacle terminals, the grounding plate module comprises the grounding plate and a grounding insulated member, the grounding insulated member is on a portion of an outer surface of the grounding plate and assembled with the first terminal module and the second terminal module, wherein the first terminal module, the second terminal module, and the grounding plate module are assembled and molded with each other to form the insulated housing.

* * * * *